United States Patent [19]

Farrall et al.

[11] 4,063,991

[45] Dec. 20, 1977

[54] METHOD OF INCREASING VOLTAGE WITHSTANDING CAPABILITY OF VACUUM INTERRUPTERS

[75] Inventors: George A. Farrall; William A. Gilhooley, both of Schenectady; Frank G. Hudda, Latham, all of N.Y.

[73] Assignee: General Electric Company, Schenectady, N.Y.

[21] Appl. No.: 761,461

[22] Filed: Jan. 21, 1977

Related U.S. Application Data

[63] Continuation-in-part of Ser. No. 648,669, Jan. 13, 1976, abandoned.

[51] Int. Cl.[2] ..... H01H 9/30

[52] U.S. Cl. ..... 156/645; 65/31; 65/61; 156/663; 200/144 B

[58] Field of Search ..... 156/645, 663; 65/31, 65/61, 102, 111; 200/144 B; 313/313, 333

[56] References Cited

U.S. PATENT DOCUMENTS

| | | | |
|---|---|---|---|
| 3,527,628 | 9/1970 | Fullerton et al. | 65/31 |
| 3,813,276 | 5/1974 | Trap | 156/663 |
| 3,843,472 | 10/1974 | Toussaint et al. | 65/31 |
| 4,029,921 | 6/1977 | Rich et al. | 200/144 B |

*Primary Examiner*—Charles E. Van Horn
*Assistant Examiner*—Jerome W. Massie
*Attorney, Agent, or Firm*—Marvin Snyder; Joseph T. Cohen; Jerome C. Squillaro

[57] ABSTRACT

Loose glass particles in a vacuum interrupter, and glass attached to the interrupter midband, are removed with an etch of hydrofluoric acid applied over the entire interior of the glass envelope and the midband, following a grit blast of the entire interior of the glass envelope and the midband.

6 Claims, 3 Drawing Figures

285 μ

285 μ

METHOD OF INCREASING VOLTAGE WITHSTANDING CAPABILITY OF VACUUM INTERRUPTERS

INTRODUCTION

This is a continuation-in-part of application Ser. No. 648,669, filed Jan. 13, 1976, now abandoned.

This invention relates to vacuum interrupters, and more particularly to an improved method of fabricating such interrupters to be free of glass particles during normal operation.

A common type of vacuum interrupter on the market is fabricated with a centrifugally-cast glass envelope. Such interrupters may suffer serious degradation of voltage-withstanding capability due, we have found, to glass particle contamination within the sealed envelope. We have determined that these particles originate largely from two main sources. The envelope is typically fabricated with a band of metal cast into the glass at its axial midplane. The band extends radially-inward beyond the inside surface of the glass wall for a distance typically of about three-eighths inch, and serves to support a metal cylinder which shields the inside surface of the glass wall from deposits of metal vapor generated by the electrode surfaces during normal arcing of the interrupter. This midband is coated with glass deposits that are formed of residual glass from the envelope casting operation and are very difficult to remove despite a grit blast cleaning operation. During normal operation, the tube undergoes great mechanical shock, causing the midband, which is made of relatively thin metal, to flex. We have discovered that during this flexing, at least a portion of the residual glass chips off. Thus the midband is one source of glass particles in the device.

A second source of glass particle contamination has proven to be the inside wall of the glass envelope itself. After the envelope has been cast, not only is the midband grit-blasted to remove glass deposits, but also the inside glass wall is grit-blasted to roughen it for the purpose of lengthening the electrical path over the glass surface so as to improve its dielectric performance. We have found, however, that grit-blasting leaves the inside surface of the glass in a mechanically unstable condition that can easily result in the surface becoming an abundant source of loose glass debris.

Accordingly, one object of the invention is to provide a vacuum interrupter that can reliably withstand high voltages.

Another object is to provide a method of fabricating vacuum interrupters without contaminating the interior thereof with glass particles.

Another object is to provide a simple and effective method of removing glass deposits bonded to the midband of a vacuum interrupter.

Briefly, in accordance with a preferred embodiment of the invention, a method of treating a vacuum interrupter to withstand high voltages is disclosed, the interrupter being comprised of a glass envelope and a metallic member cast into the envelope. The method comprises blasting the interior of the envelope, including the metallic member, with gas-propelled abrasive material in the form of grit, and thereafter etching, with hydrofluoric acid, the interior of the envelope, including the metallic member, to remove loose glass particles and glass adhering to the member.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

DESCRIPTION OF TYPICAL EMBODIMENTS

Figure 1:
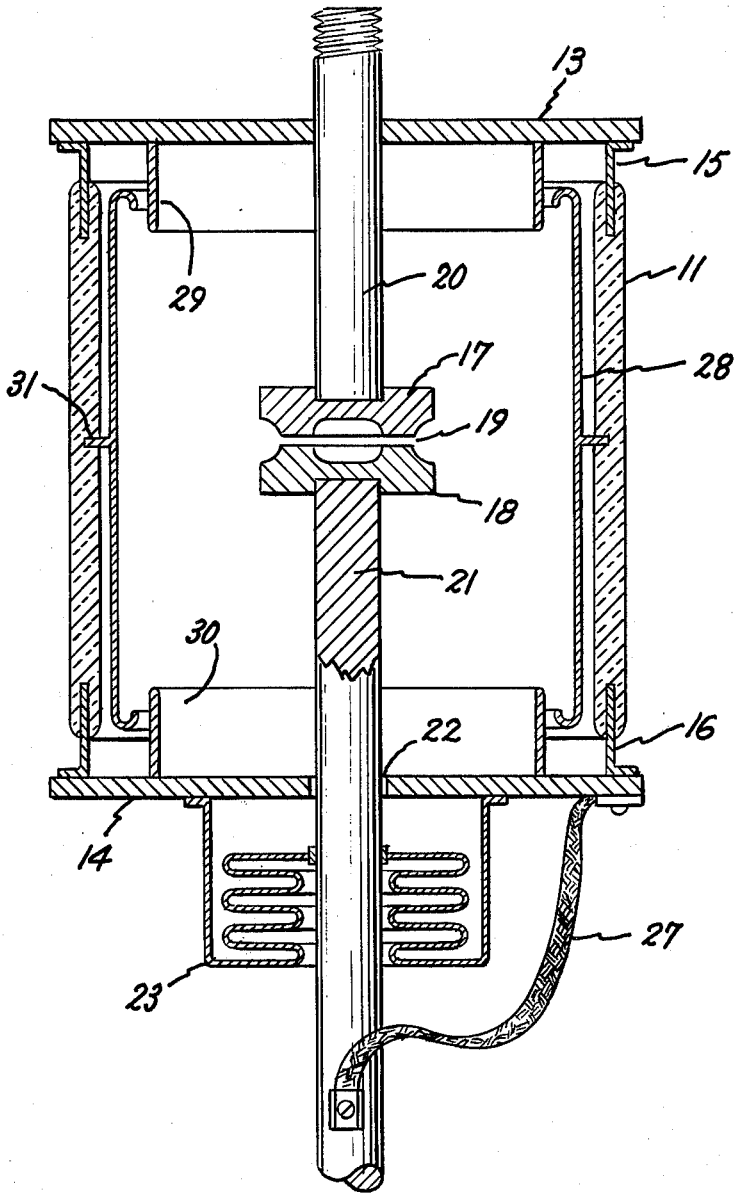
FIG. 1 is a schematic sectional view of a typical vacuum switch which may be fabricated by a process employing the instant invention.

In FIG. 1, a vacuum switch is represented as comprising an evacuable glass envelope 11 hermetically sealed to respective upper and lower metallic end walls 13 and 14 by means of metallic flanges 15 and 16, respectively. The flanges are sealingly affixed to the inner sides of the respective end walls, as by welding, and sealed to the respective ends of glass wall 11 as by being embedded therein. A pair of primary arc-electrodes 17 and 18 defining an arcing gap 19 therebetween when in open circuit position are supported upon respective arc-electrode support rods 20 and 21. Support rod 20 is electrically and mechanically affixed to metallic end wall member 13. Support rod 21 is reciprocally movable through an aperture 22 in end wall member 14. Vacuum integrity of the device is maintained, while reciprocal mobility is allowed to support rod 21, by means of bellows assembly 23 affixed hermetically to end wall 14 and electrode support rod 21. To assure that the main conduction current during arcing and steady-state operation bypasses bellows assembly 23, a flexible bus strap 27 is attached at one end to support rod 21 below bellows assembly 23 and at the other end to end wall 14.

Arcing shield means in the vacuum interrupter protect glass wall 11 from deposition thereon of conducting species emanating from gap 19 when electrodes 17 and 18 sustain an electric arc. The arcing shield means comprises a main arcing shield 28 and a pair of secondary arc shields 29 and 30. Main arcing shield 28 constitutes a hollow metallic cylinder with anti-arcing ferrules at its axial ends. Shield member 28 is supported from glass wall 11 by attachment, as by welding, to a metallic member such as midband 31 cast into the glass at its axial midplane. Auxiliary arcing shields 29 and 30 constitute cylindrical stub members electrically and mechanically attached to end walls 13 and 14, respectively, and extend sufficiently inward to be contained within the volume encompassed by primary shield member 28. A typical vacuum switch of the type illustrated is described and claimed in L. P. Harris U.S. Pat. No. 3,851,203, issued Nov. 26, 1974 and assigned to the instant assignee.

In fabricating apparatus such as illustrated in FIG. 1, midband 31 is subjected to a high temperature oxidation cycle prior to casting of glass envelope 11, in order that the glass may readily and securely bond to the surface of the midband and form a tight seal thereto over most of the midband area when the envelope is cast. After the envelope has been cast, midband 31 is abrasiveblasted with dry grit propelled by a gas, such as air, to remove excess glass from the midband surfaces. Additionally, the entire inner surface of glass envelope 11 is roughened by the grit-blasting operation in order to enhance voltage withstand capability of that surface by lengthening the creepage distance over the glass. However, as we have discovered, the grit blast leaves the glass surface in a mechanically unstable condition which can easily result in the surface becoming a major source of glass particle contamination.

Since the midband has previously been subjected to a high temperature oxidation cycle in order to secure better adhesion to glass envelope 11, glass adhering to the midband is not readily removed by grit blasting. We have determined that because the midband is of relatively narrow thickness, large mechanical shocks experienced by the midband during normal vacuum interrupter operation cause the midband to flex, resulting in residual glass chipping off. Consequently, the midband is also a potentially major source of glass particle contamination.

We have found that potential contamination of the vacuum interrupter with glass particles from the internal, grit-blasted surfaces can be reduced by etching the entire interior of the vacuum switch envelope with hydrofluoric acid as a finishing step. In general, the product of the volumetric percent of HF concentration in the acid and the etching duration, in minutes, should be a minimum of about 200, with HF concentration in the acid being in the range of 10% to 24% by volume at room temperature (while lower temperatures would allow etching with hydrofluoric acid having a higher volumetric concentration of HF). No other alteration in present production practice is necessary. In this fashion, the midband is cleaned, the mechanically unstable parts of the glass surface are removed, and the long creepage path over the inside glass surface is retained. Those skilled in the art will recognize that, in the alternative, other glass etchants, such as ammonium bifluoride, may be employed instead of hydrofluoric acid.

As a specific example, two vacuum interrupter glass envelopes which had been grit-blasted in conventional production fashion with grit particles of approximately 100–200 micrometers diameter were etched for fifteen minutes in a 20 percent HF solution by volume by capping one end and filling the envelope with the hydrofluoric acid. After the etch, the envelope was washed to remove the acid. Inspection of the midband showed that the glass residue left on the midband after grit blast had been removed by the acid etch. Effectiveness of this procedure in reducing possible contamination of the vacuum interrupter from the internal, grit-blasted surface was assessed in the following manner.

Figure 2:
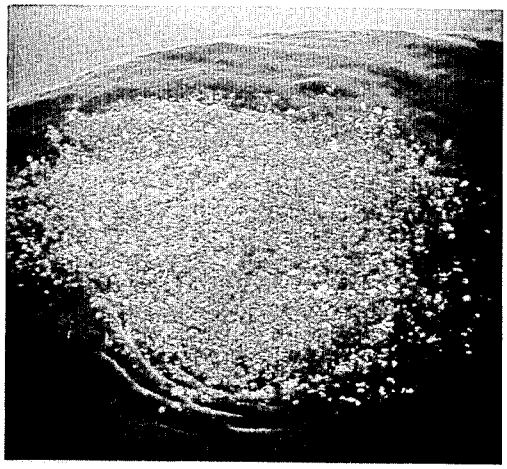
FIG. 2 is an electron micrograph of a probe tip surface showing glass particles picked up by the probe from the interior surface of the glass envelope of a vacuum interrupter fabricated in a conventional manner.
Figure 3:
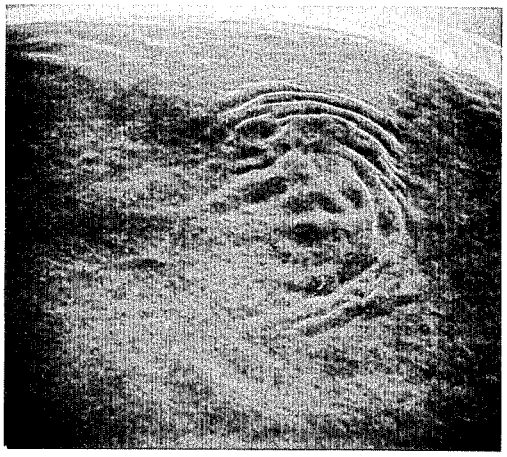
FIG. 3 is an electron micrograph of a probe tip surface showing a substantially reduced number of glass particles picked up by the probe from the interior surface of the glass envelope of a vacuum interrupter fabricated in accordance with the teachings of the instant invention.

A segment of one-eighth inch diameter copper rod about one-half inch in length was cut and carefully cleaned. This was attached to a longer piece of rod that could be used as a handle. A small amount of conducting adhesive, such as Conductive Specimen Cement, Part No. 10010-228, available from Coates and Welter Instrument Corporation, Sunnyvale, Calif., was applied to the tip of the free end of the short piece and allowed to harden partially. This tip was then pressed seven times in succession against the interior surface of a vacuum interrupter glass envelope taken from a recently-opened General Electric PV-3H vacuum interrupter that had been fabricated using standard procedures. The probe tip was then removed from the handle and examined under a scanning electro microscope, resulting in the micrograph of FIG. 2. The black background substance in FIG. 2 is the adhesive. The "sugar-like" coating on the adhesive is a dense layer of glass particles picked up by the probe from the envelope. Similar probing of a vacuum interrupter envelope etched in hydrofluoric acid in accordance with the abovedescribed procedure resulted in the scanning electron microscope micrograph shown in FIG. 2. As evident in FIG. 3, particulate contamination has been markedly reduced.

Further experiments were carried out to determine effectiveness of four different etching procedures on reducing likelihood of glass contamination from internal glass envelope surfaces. For this purpose, a number of glass segments of approximately equal size were cut from a standard vacuum interrupter envelope using a diamond saw. For these samples, an etch in 10% HF solution by volume for 20 minutes served to clean the glass of the envelopes adequately.

The foregoing describes a method of fabricating a vacuum interrupter that can reliably withstand high voltages. The method avoids contaminating the interior of the interrupter with glass particles, and constitutes an effective way of removing glass deposits bonded to the midband of the interrupter.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

We claim:

1. In the method of fabricating a vacuum interrupter, said interrupter including a glass envelope and a metallic member cast into said envelope, the method of increasing the voltage withstanding capability of said interrupter comprising the steps of: blasting the interior of said envelope with gas-propelled grit; and etching the interior of said envelope, including said metallic member, so as to remove loose glass particles and glass adhering to said member.

2. The method of claim 1 wherein said etching is performed by hydrofluoric acid.

3. The method of claim 2 wherein said hydrofluoric acid comprises substantially a 20% HF solution by volume at room temperature and said step of etching is continued for substantially 15 minutes.

4. The method of claim 2 wherein said hydrofluoric acid comprises substantially a 10% HF solution by volume at room temperature and said step of etching is continued for substantially 20 minutes.

5. The method of claim 2 wherein HF concentration in said hydrofluoric acid is in the range of 10% to 24% by volume at room temperature and the product of said HF concentration in percent and duration of etching in minutes exceeds approximately 200.

6. The method of claim 5 wherein said etching occurs at room temperature.

* * * * *